US007381158B2

(12) United States Patent
Girard et al.

(10) Patent No.: US 7,381,158 B2
(45) Date of Patent: Jun. 3, 2008

(54) ELLIPTICAL EXERCISER

(75) Inventors: Mario Girard, St-Còme-Linière (CA); Jess Tremblay, St-Fulgence (CA)

(73) Assignee: Bodyguard Fitness, St-Georges (CA)

( * ) Notice: Subject to any disclaimer, the term of this patent is extended or adjusted under 35 U.S.C. 154(b) by 683 days.

(21) Appl. No.: 10/622,574

(22) Filed: Jul. 21, 2003

(65) Prior Publication Data

US 2005/0277516 A1 Dec. 15, 2005

(30) Foreign Application Priority Data

Jul. 19, 2002 (CA) ..... 2394249

(51) Int. Cl.
*A63B 22/00* (2006.01)
*A63B 22/04* (2006.01)

(52) U.S. Cl. ..... 482/51; 482/57

(58) Field of Classification Search ..... 482/52, 482/57, 70, 79–80

See application file for complete search history.

(56) References Cited

U.S. PATENT DOCUMENTS

| | | | | |
|---|---|---|---|---|
| 4,824,102 | A | 4/1989 | Lo | |
| 4,902,001 | A | 2/1990 | Balbo | |
| 5,163,888 | A | 11/1992 | Stearns | |
| 5,407,409 | A | 4/1995 | Tang | |
| 5,501,648 | A | 3/1996 | Grigoriev | |
| 5,836,856 | A | 11/1998 | Mattoo et al. | |
| 5,895,339 | A * | 4/1999 | Maresh | 482/51 |
| 6,045,487 | A * | 4/2000 | Miller | 482/52 |
| 6,146,313 | A * | 11/2000 | Whan-Tong et al. | 482/51 |
| 6,196,948 | B1 * | 3/2001 | Stearns et al. | 482/52 |
| 6,328,677 | B1 | 12/2001 | Drapeau | |
| 7,052,438 | B2 * | 5/2006 | Eschenbach | 482/52 |
| 7,137,927 | B2 * | 11/2006 | Maresh et al. | 482/52 |

* cited by examiner

*Primary Examiner*—Stephen R. Crow
(74) *Attorney, Agent, or Firm*—Ogilvy Renault LLP

(57) ABSTRACT

A foot pedal mechanism for an elliptical exerciser comprising a frame. A pair of foot pedals are adapted to each support thereon a foot of the user standing on the elliptical exerciser. A crank for each the foot pedal is operatively connected to a respective one of the foot pedals such that a rotation of each of the crank about an axis of rotation thereof causes a first motion restriction of the respective one of the foot pedals. First linkages interconnect the cranks to the frame such that at least the axis of rotation of each of the crank is displaceable with respect to the frame to cause a second motion restriction of the respective one of the foot pedals. A combination of the first and second motion restrictions results in the foot pedals being restricted to an elliptical path of motion. The cranks are interconnected to synchronize a displacement of the foot pedals with respect to one another along the elliptical path of motion.

8 Claims, 7 Drawing Sheets

ELLIPTICAL EXERCISER

BACKGROUND OF THE INVENTION

1. Field of the Invention

The present invention relates to elliptical exercisers and, more particularly, to foot pedal mechanisms thereof, and to a relation between upper- and lower-body workouts in elliptical exercisers.

2. Description of the Prior Art

Elliptical exercisers, also known as ellipticals, elliptical trainers and elliptical exercise machines, combine the natural stride provided by a treadmill and the simplicity of a stair climber. On an elliptical exerciser, a user stands upright comfortably while holding onto the exerciser's handrails and strides in either a forward or reverse motion. The handrails are often moveable and are synchronized with the pedals upon which the user strides, to provide a full upper- and lower-body workout.

Elliptical exercisers are unique in their ability to put minimal stress on the joints while offering a weight-bearing workout, and this has ramifications in the inhibition of the onset of osteoporosis. The feet of the user never leave the pedals of the exerciser, thereby eliminating any impact in the workout. Therefore, there is a reduced risk of injury from overusing any given muscle group, thereby facilitating training for anyone with back, knee, hip and joint problems. The low-impact, intensive, cardiovascular workout provided by the elliptical exerciser is achieved through natural and smooth motion.

The mechanisms incorporated into elliptical exercisers move in a continuous smooth motion and do not suffer the effects of direction reversal (e.g., in a stair-climber, the feet must change direction virtually instantaneously). In addition, elliptical exerciser technology provides a more functional pattern of movement. Since elliptical exercisers simulate a natural walking pattern, they can easily be accompanied by upper-body exercise. Many other devices, by their mechanical structure (e.g., treadmills) or by their pattern (e.g., cycling), do not readily adapt to upper-body workouts.

The various manufacturers of elliptical exercisers have developed many iterations of this basic technology. As a result, the state of the art includes a plurality of machines that have a different "feel"—e.g., the articulation of the ankle, knee and hip can be different.

SUMMARY OF THE INVENTION

It is an aim of the present invention to provide a new elliptical exerciser.

It is a further aim of the present invention to provide a novel foot pedal mechanism.

It is a still further aim of the present invention to provide an elliptical exerciser having a foot pedal mechanism and a handlebar mechanism independent from one another.

Therefore, in accordance with the present invention, there is provided a foot pedal mechanism for an elliptical exerciser comprising: a frame; a pair of foot pedals adapted to each support thereon a foot of the user standing on the elliptical exerciser; a crank for each said foot pedal, each said crank being operatively connected to a respective one of the foot pedals such that a rotation of each said crank about an axis of rotation thereof causes a first motion restriction of the respective one of the foot pedals; and first linkages interconnecting said cranks to the frame such that at least the axis of rotation of each said crank is displaceable with respect to the frame to cause a second motion restriction of the respective one of the foot pedals, a combination of said first and second motion restrictions resulting in the foot pedals being restricted to an elliptical path of motion, the cranks being interconnected to synchronize a displacement of the foot pedals with respect to one another along the elliptical path of motion.

Further in accordance with the present invention, there is provided an elliptical exerciser comprising a frame; a foot pedal mechanism having a pair of foot pedals, the foot pedals being displaceable with respect to the frame according to a given path of motion and adapted to each support thereon a foot of a user standing on the elliptical exerciser, the foot pedal mechanism synchronizing a displacement of the foot pedals with respect to one another to cause a leg workout of the user; and a handlebar mechanism having a pair of handlebars pivotally mounted to the frame and adapted to be grasped by the hands of the user, the handlebar mechanism synchronizing a displacement of the handlebars with respect to one another to cause an upper body workout; wherein the foot pedal mechanism and the handlebar mechanism are independent from one another.

BRIEF DESCRIPTION OF THE DRAWINGS

Reference will now be made to the accompanying drawings, showing by way of illustration a preferred embodiment thereof and in which.

DESCRIPTION OF THE PREFERRED EMBODIMENTS

Figure 10A:
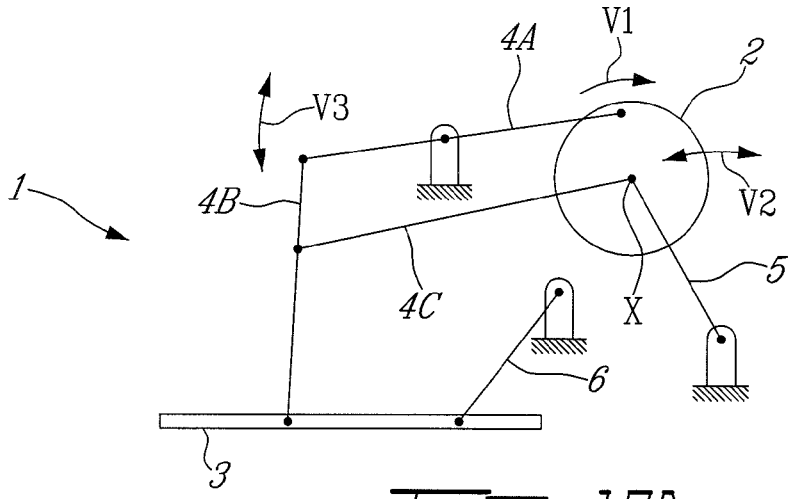
FIG. 10A is a schematic view of a foot pedal mechanism in accordance with an aspect of the present invention.

The present invention is associated with foot pedal mechanisms for elliptical exercisers. The foot pedal mechanisms must impart an elliptical path of movement to the pedals of the exerciser. Referring to FIG. 10A, a first foot pedal mechanism in accordance with the present invention is generally shown at 1. The foot pedal mechanism 1 has a crank 2 connected to a foot pedal 3 by links 4A, 4B and 4C. The crank 2 rotates about an axis of rotation X. The link 4A, connected eccentrically to the crank 2, receives the circular motion V1 of the crank 2. The crank 2 is linked to a frame by a link 5, whereby the axis of rotation X of the crank 2 is displaceable. As the link 4A is also secured to the frame, a rotation of the crank 2 will have the axis of rotation of the crank 2 achieve a rocking motion as shown by V2.

The link 4B is connected to a free end of the link 4A, and will thus rock vertically (according to V3) through the transmitted motion from the link 4A. The link 4C is connected at opposed ends to the axis of rotation X of the crank 2 and to a central portion of the link 4B, so as to impart the horizontal rocking motion V2 of the axis of rotation X of the crank 2. Accordingly, the combination of the horizontal rocking motion V2 and the vertical rocking motion V3, along with a synchronization with a reciprocal foot pedal for the other foot of the user, will have the foot pedal 3 move in an elliptical motion. A link 6 ensures that the foot pedal 3 remains generally horizontal.

Therefore, the use of a crank enables to bring a circular motion to a foot pedal. If the axis of rotation of the crank is displaceable in translation, a circular motion typically imparted by a crank can be deformed into an elliptical motion.

Figure 10B:
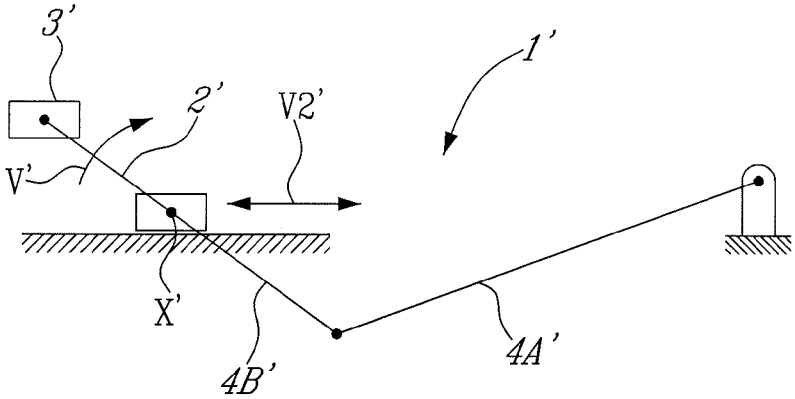
FIG. 10B is a schematic view of a foot pedal mechanism in accordance with a further aspect of the present invention.

As a further example of this principle, a foot pedal mechanism also in accordance with the present invention is generally shown at 1' in FIG. 10B. The foot pedal mechanism 1' has a crank 2' that is displaceable in rotation according to V1' and that may translate along V2' on a frame. A foot pedal 3' is mounted to the crank 2' so as to rotate about the axis of rotation X' of the crank 2'. A link 4A' interconnects an extension 4B' of the crank 2' to the frame, so as to limit the translation of the crank 2' along V2'. By a synchronization with a reciprocal foot pedal for the other foot of the user, the foot pedal 3' is displaceable along an elliptical path by the combination of the motions V1' and V2'.

Figure 10C:
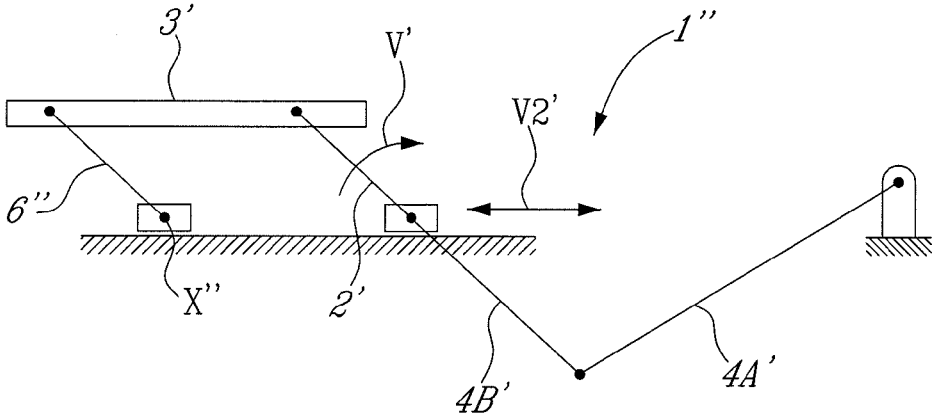
FIG. 10C is a schematic view of a foot pedal mechanism in accordance with a still further aspect of the present invention

Referring to FIG. 10C, a foot pedal mechanism also in accordance with the present invention is generally shown at 1". The foot pedal mechanism 1" operates in similar fashion to the foot pedal mechanism 1' of FIG. 10B. Therefore, like elements bear like reference numerals. However, the foot pedal mechanism 1" further includes a crank 6" that will ensure that the foot pedal 3' remains generally horizontal. The crank 6" follows the action of the leading crank 2'.

The above described foot mechanisms each have a crank whose axis of rotation is moveable, to convert a circular motion of the crank into an elliptical path of motion for the foot pedals.

Referring to FIGS. 1 to 6, an elliptical exerciser in accordance with the present invention is generally shown at 10. The elliptical exerciser 10 has a foot pedal mechanism equivalent to the foot pedal mechanism 1 of FIG. 10A. The elliptical exerciser 10 has various known components of typical elliptical exercisers. More precisely, the elliptical exerciser 10 has a frame 12 consisting of a base frame 14 and an upper frame 16. A training support computer 18 is positioned at a top end of the upper frame 16, and is in the line of sight of a user of the elliptical exerciser 10. A fixed handlebar 20 is slideably mounted to the upper frame 16, and is vertically displaceable so as to be adjusted before being secured to the upper frame 16, to reach a desired height position for the user. Exercise handlebars 22 are pivotally mounted at pivot 24 to the upper frame 16 and are provided for the upper-body workout of the elliptical exerciser 10. The exercise handlebars 22 are part of a handlebar mechanism 26 that enables the exercise handlebars 22 to be synchronized in motion. For instance, the handlebars 22 can be synchronized to a 180° out-of-phase motion with respect to one another to provide an upper-body workout similar to that of a striding cross-country skier. The handlebar mechanism 26 can also provide an adjustable resistance level to the handlebars 22. The handlebar mechanism 26 operates independently from a foot pedal mechanism as will be described in further detail herein.

The foot pedal mechanism of the elliptical exerciser 10 is generally shown at 30. The foot pedal mechanism 30 can be separated into left and right mechanism portions. The left and right mechanism portions consist of the same components, whereby a generic mechanism will be generally described, and the reference numerals of the components of the right mechanism portion will be characterized by bearing the suffix "R" in FIGS. 1 to 8, whereas the reference numerals of the left mechanism portion will be characterized by bearing the suffix "L" in FIGS. 1 to 8. Any component shared by both mechanism portions will be described as such.

Figure 8:
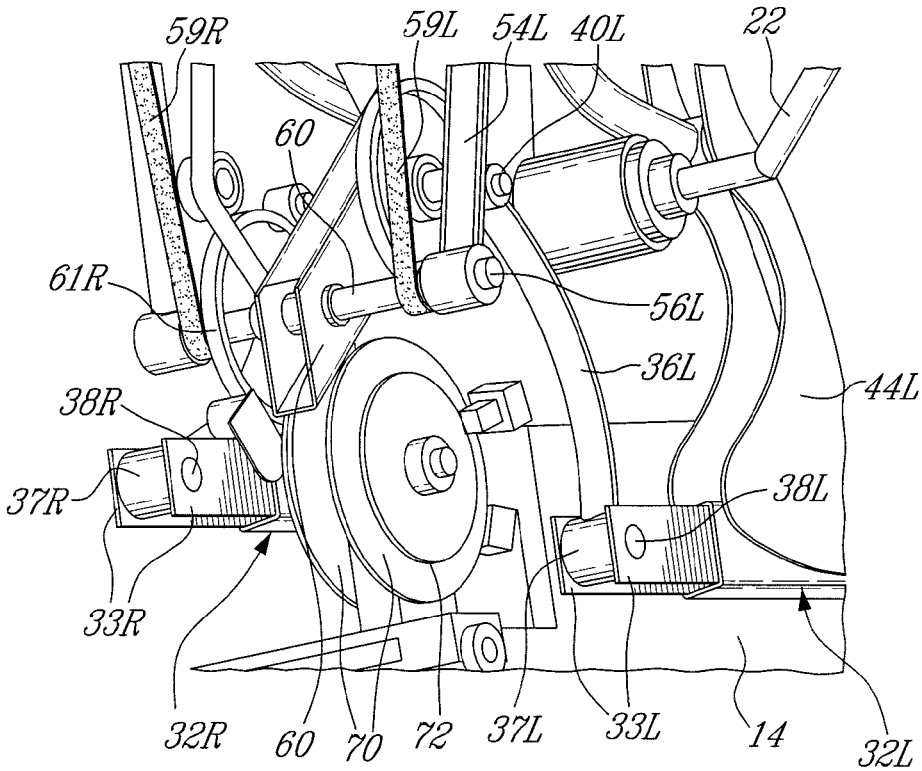
FIG. 8 is an enlarged perspective view of a part of the foot pedal mechanism of the elliptical exerciser.

A foot pedal 32 is provided with a foot support surface 34, typically providing some adherence to the foot of a user of the exerciser 10. The foot pedal 32 is pivotally mounted at a front end thereof to a horizontal displacement link 36 by pivot 38. More precisely, as shown in FIG. 8, a pair of spaced plates 33 extend forwardly from the front end of the foot pedal 32, and receive therebetween a pivot head 37 of the horizontal displacement link 36 (hereinafter the "HD link 36"). The HD link 36 is pivotally mounted at a free end thereof to the upper frame 16 at pivot 40. Therefore, the front end of the foot pedal 32, i.e., where the pivot 38 is, defines arcuate motions about the pivot 40.

Referring to FIGS. 1 to 6, the foot pedal 32 is connected to a vertical displacement link 42 via a transmission link 44. More precisely, the transmission link 44 is pivotally mounted at pivot 46 to a generally central portion of the foot pedal 32. An opposed upper end of the transmission link 44 is pivotally connected by pivot 48 to the vertical displacement link 42 (hereinafter "VD Link 42"). The VD link 42 is pivotally connected, at a central portion thereof, by pivot 50 to the upper frame 16.

A crank link 54 has a bottom end thereof pivotally mounted at pivot 56 to the upper frame 16. More precisely, as best seen in FIG. 8, the bottom end of the crank link 54 defines a sleeve freely mated to a horizontal transmission shaft 60, which is rotatably mounted to the upper frame 16. Therefore, the transmission shaft 60, only one of which is provided for both right and left mechanism portions, can rotate in the upper frame 16 independently of the crank link 54. Likewise, the crank link 54 can pivot freely about the transmission shaft 60.

Figure 1:
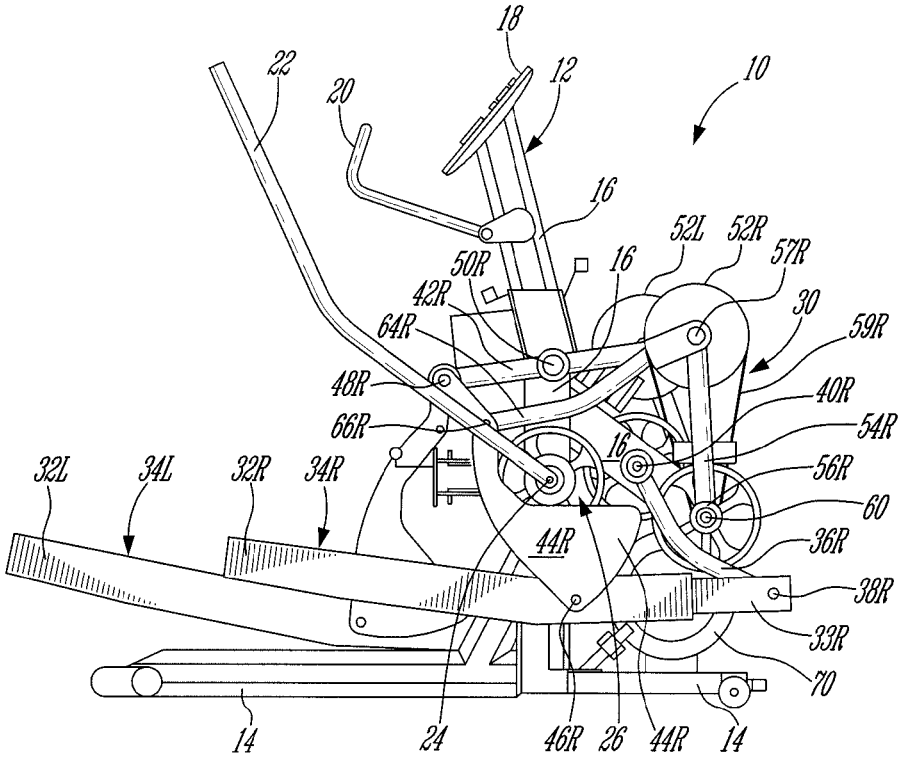
FIG. 1 is a side elevational view of an elliptical exerciser in accordance with the present invention.
Figure 2:
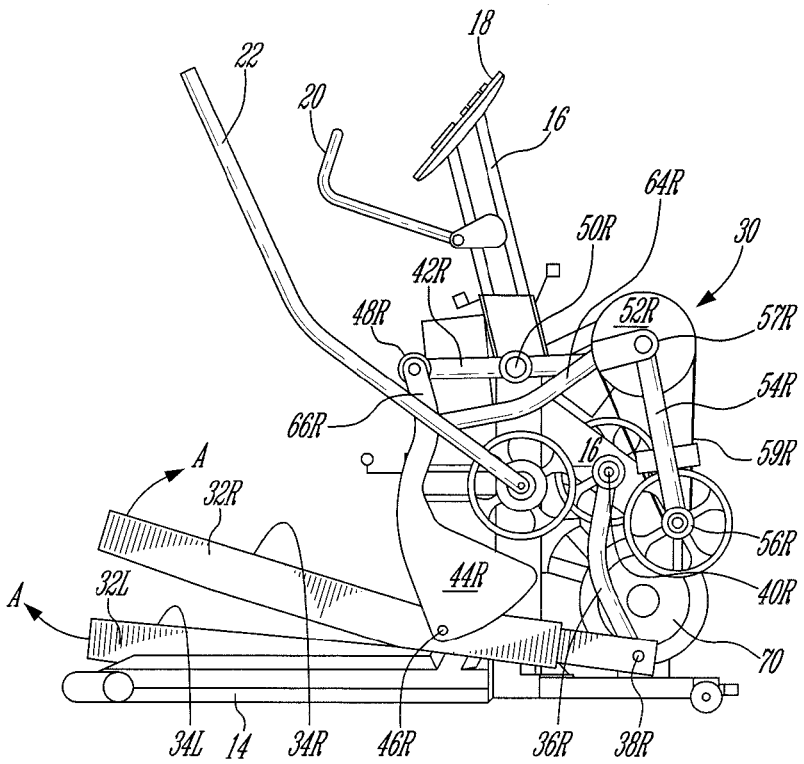
FIG. 2 is a side elevational view of the elliptical exerciser in a first position of an operating sequence.
Figure 3:
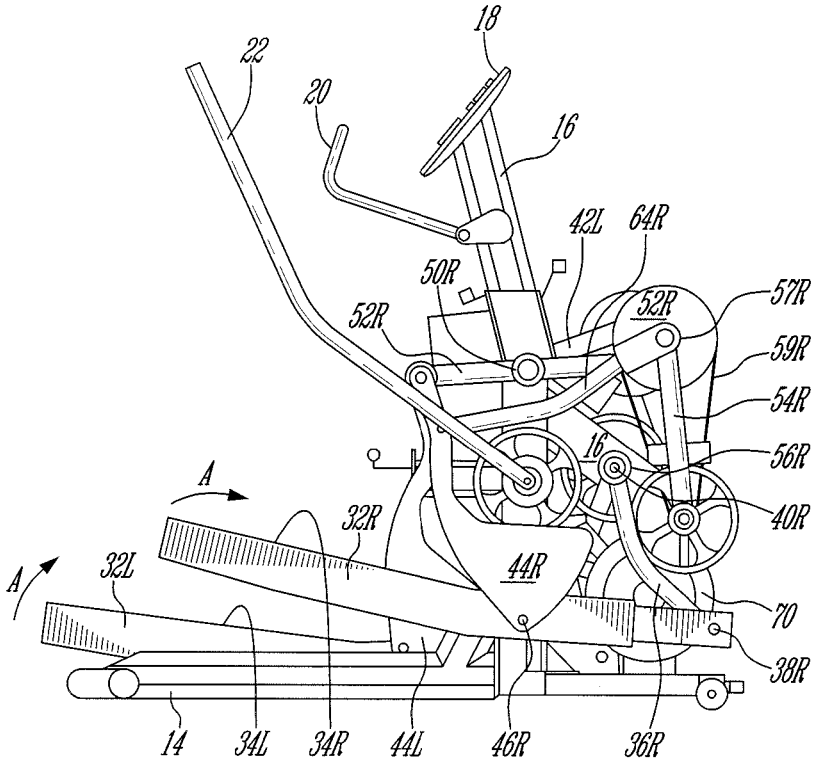
FIG. 3 is a side elevational view of the elliptical exerciser in a position of the operating sequence subsequent to the first position of FIG. 2.
Figure 4:
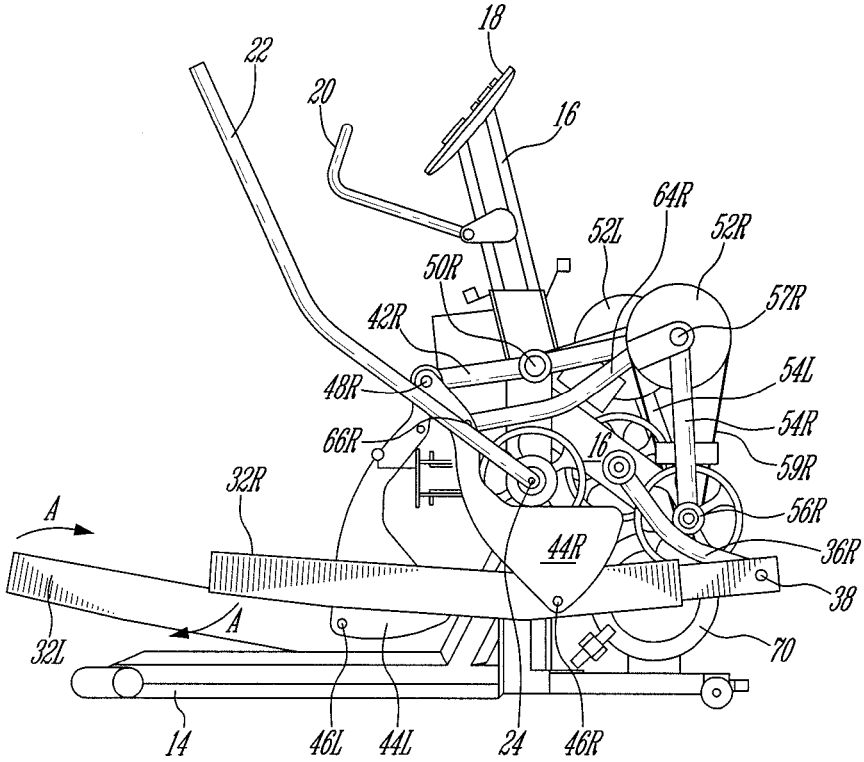
FIG. 4 is a side elevational view of the elliptical exerciser in a position of the operating sequence subsequent to the position of FIG. 3.
Figure 5:
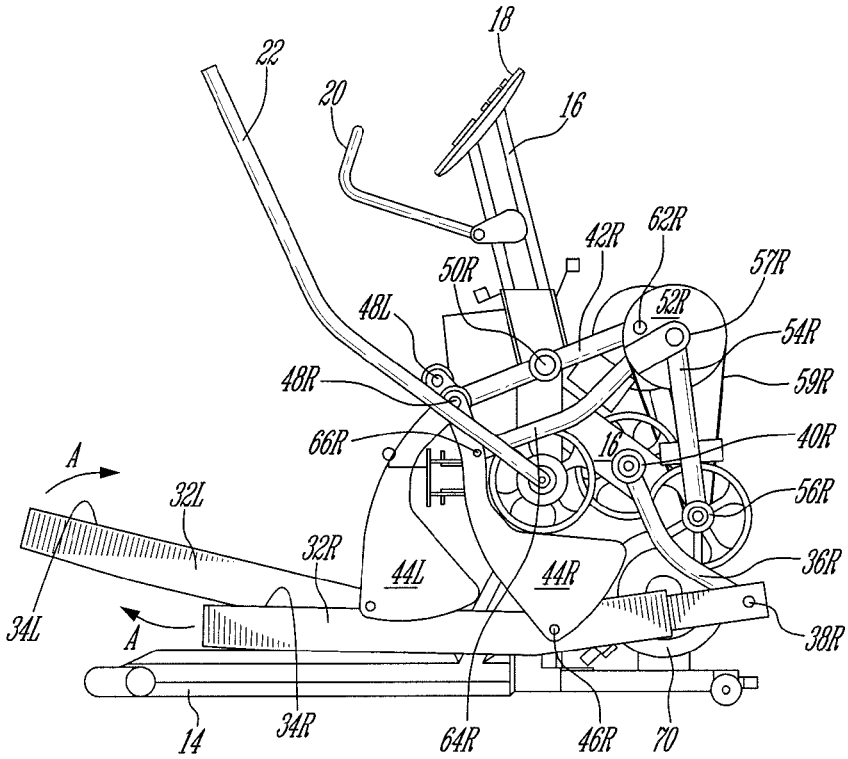
FIG. 5 is a side elevational view of the elliptical exerciser in a position of the operating sequence subsequent to the position of FIG. 4.
Figure 6:
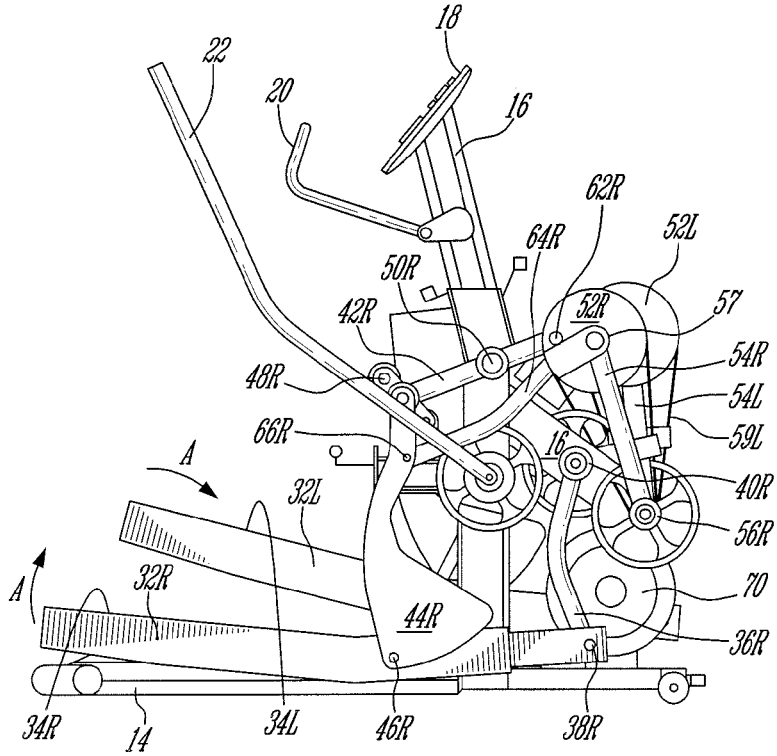
FIG. 6 is a side elevational view of the elliptical exerciser in a position of the operating sequence subsequent to the position of FIG. 5.
Figure 7:
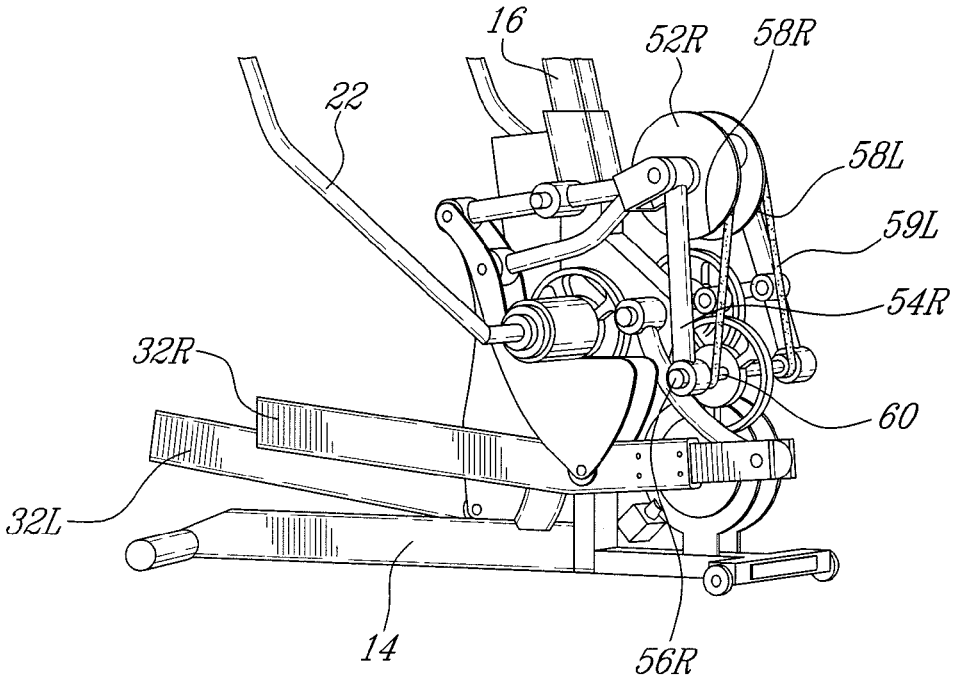
FIG. 7 is a perspective view of a foot pedal mechanism of the elliptical exerciser.

Referring to FIGS. 1 to 6, a crank wheel 52 is rotatably mounted, at a center 57 thereof, to an upper free end of the crank link 54, so as to rotate freely with respect to this free end. However, the center 57 of the crank wheel 52 can be displaced arcuately about the pivot 56. As seen in FIG. 7, the crank wheel 52 defines a pulley-shaped peripheral surface 58.

The transmission shaft 60 has pulleys 61R and 61L secured thereon, whereby belts 59R and 59L transmit motion between the two crank wheels 52. The pulleys 61R and 61L and the crank wheels 52R and 52L are of the same diameter, respectively, whereby the crank wheels 52R and 52L are synchronized in motion. It is obvious that chains and gears or other similar equipment can be used instead of pulleys and belts.

Referring to FIGS. 1 to 6, the VD link 42 has a front end thereof pivotally mounted at 62 (see FIGS. 5 and 6) to a radial, i.e., off-centered portion of the crank wheel 52. Therefore, a rotation of the crank wheel 52 causes the VD link 42 to displace the transmission link 44 generally vertically, as pivot 48 can be displaceable arcuately about pivot 50. Consequently, the movement of the transmission link 44 is transmitted to the foot pedal 32, whose rear end, which supports a foot of the user, moves generally up and down. It is pointed out that a rotation of the crank wheel 52 will cause the center 57 thereof to perform a back-and-forth arcuate displacement about the pivot 56, via the crank link 54.

The center 57 of the crank wheel 52 is connected to the transmission link 44 via an elliptical motion link 64. More precisely, the elliptical motion link 64 (hereinafter the "EM link 64") is pivotally mounted to the transmission link 44 at pivot 66. As the VD link 42 is fixed to the upper frame 16, the front end of the VD link 42, i.e., by which it is connected to the crank wheel 52 by pivot 62, can only rotate about pivot 50. Accordingly, the EM link 64, being secured to the center 57 of the crank wheel 52, will be subjected to the arcuate displacement of the center 57 of the crank wheel 52 as described above, thereby transmitting this motion to the transmission link 44. A combination of this arcuate displacement (causing a first motion restriction) with the generally vertical displacement (causing a second motion restriction) caused by the VD link 42 rotating about the center 57 of the crank wheel 52 will cause the pivot 66 on the transmission link 44 to be displaced in an elliptical pattern of motion. This elliptical pattern of motion is then transmitted to the foot pedal 32, whose rear end, which includes the foot support surface 34, will move likewise.

As shown in FIG. 8, magnetic resistance wheels 70 are mounted to the base frame 14, and each has a pulley section 72, with one of the resistance wheels 70 being connected to the transmission shaft 60 via a belt (not shown). Therefore, various resistance levels can be transmitted from one of the magnetic resistance wheels 70 to the transmission shaft 60, and this supplemental resistance will be applied against the foot pedals 32 in motion along their elliptical paths. The other one of the magnetic resistance wheels 70 is used with the handlebar mechanism 26. The magnetic resistance wheels 70 are wired to the training support computer 18, whereby the magnitude of the resistance can be changed by the user of the elliptical exerciser 10. It is obvious that the training support computer 18 can be programmed to gradually increase, or provide various patterns of resistance to each of the magnetic resistance wheels 70. As the resistance wheels 70 are independent from one another, the resistance set to the handlebars 22 and to the foot pedals 32 can be adjusted independently from one another.

FIGS. 2 to 6 have been placed in order of operation sequence. Arrows A illustrate the arcuate path that each foot pedal 32 will be performing to reach the position of the subsequent figure.

It is seen from FIGS. 2 to 6 that the foot pedals 32R and 32L are out of phase by 180° with respect to one another. Therefore, while one of the foot pedals 32 is in an upper position of the elliptical path, moving in a forward direction, the other one of the foot pedals 32 will be in a lower portion of the elliptical path, moving in a rearward direction. The foot pedals 32 can be displaced in either direction of the elliptical path. The ratios of the pulleys 61 and of the peripheral surfaces 58 of the crank wheels 52 will ensure that the foot pedals 32 are always out of phase by 180° along the elliptical path.

The foot pedal 32 that will be in the upper portion of the elliptical path, on the verge of moving downwardly, will transmit motion to the other foot pedal 32 via the foot pedal mechanism 30. The fact that the motion of the handlebars 22 is independent from the motion of the foot pedals 32 enables the adjustment of the intensity of the upper-body workout independently from the intensity level of the lower-body workout. Accordingly, if one's legs are stronger than one's arms, one may increase the intensity of the leg workout, while not altering one's upper-body workout. Furthermore, this configuration may be advantageous, as a user does not want his legs to compensate for the arms in the course of a combination of the upper-body workout and the lower-body workout. Therefore, the legs and the arms of the user will be performing exercises at different levels of difficulties, similarly to cross-country skiing for instance, so as to provide the full benefits of the workouts to the user.

Figure 9:
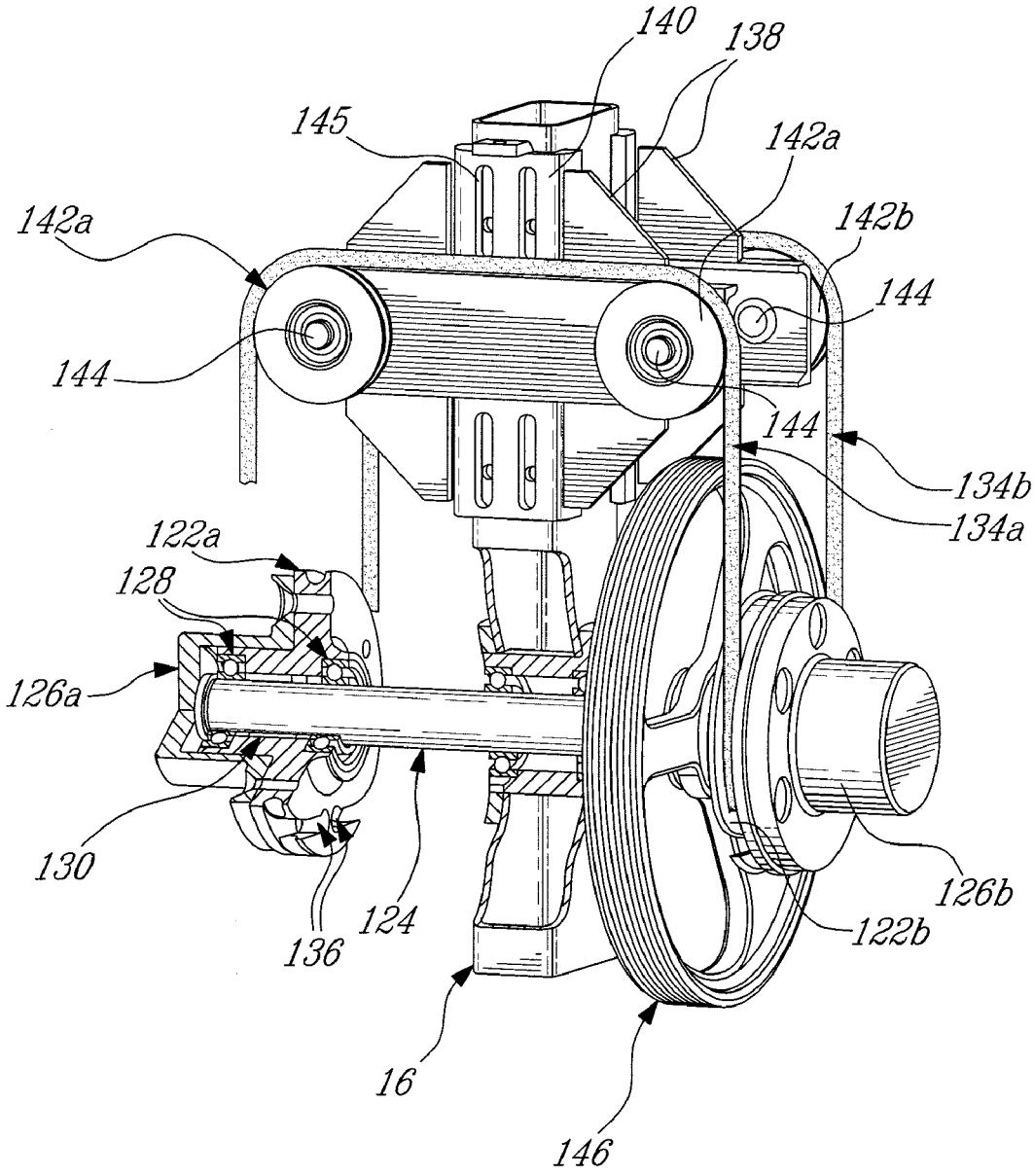
FIG. 9 is an enlarged perspective view of a handlebar mechanism for synchronizing the movement of handlebars of the elliptical exerciser.

Referring to FIG. 9, the handlebar mechanism 26 includes left and right cam pulleys 122*a* and 122*b* mounted at opposed ends of a shaft 124 journaled to the upper frame 16. The lower ends of the handlebars 22 are secured, as by welding, to respective hubs 126*a* and 126*b* which are, in turn, bolted to respective lateral outer faces of the cam pulleys 122*a* and 122*b*. Ball bearings 128 are provided for limiting the axial movement of the cam pulleys 122*a* and 122*b* on the shaft 124. Each pulley 122 has in its core a one-way clutch in the form of a clutch bearing 130 for drivingly connecting the pulley 122 to the shaft 124 in one direction, while allowing the pulley 122 to rotate freely on the shaft 124 in the opposite direction.

A pair of nylon coated steel cables 134*a* and 134*b* are connected in parallel on opposed sides of the cam pulleys 122 so that when one of the cable 134 is drawn downwardly due to the rotational movement of one of the pulley 122, it forces the other pulley 122 to rotate in the opposite direction. The cables 134 ensure joint movement of the cam pulleys 122 but in opposed directions. Each pulley 122 is provided with a pair of cable attachments 136 on opposed sides thereof. The first cable 134*a* is located on a rear facing side of the upper frame 16 and is connected at a first end thereof to the left pulley 122*a* and at a second end thereof to the right pulley 122*b*. The second cable 134*b* is located on a front facing side of the upper frame 16 and is connected at a first end thereof to the left pulley 122*a* and at a second end thereof to the right pulley 122*b*.

A cable tensioner assembly 138 is mounted to the upper frame 16 for maintaining the cables 134 under a desired tension. The cable tensioner assembly 138 includes a support structure 140 carrying rear and front pair of cable pulleys 142*a* and 142*b* mounted on respective laterally spaced-apart idle shafts 144. The first cable 134*a* extends over the rear cable pulleys 142*a*, whereas the second cable 134*b* extends over the front cable pulleys 142*b*. Elongated slots 145 are defined in the support structure 140 for receiving fasteners in order to adjustably mount the support structure 140 along the upper frame 16.

In operation, when the user pulls on the right handlebar 22 to pivot it rearwardly, the right cam pulley 122*b* rotates in the counterclockwise direction and drives the shaft 124 through the right one-way clutch 130. The pulling action exerted by the right pulley 122*b* on the cable 134*a* causes the left pulley 122*a* to rotate freely relative to the shaft 124 in the clockwise direction, thereby pivoting the left handlebar 22 in the forward direction at the same rotational speed as the right handlebar 22 being pivoted rearwardly. Thereafter, when the user pulls with his/her left arm on the left handlebar 22 to pivot it rearwardly, the left pulley 122*a* rotates in the counterclockwise direction and transmits a torque to the shaft 124 via the left clutch bearing 130. The pulling action exerted by the left pulley 122*a* on the cable 134*a* causes the right pulley 122*b* to rotate in the clockwise direction independently of the shaft 124, thereby pivoting the right handlebar 22 forwardly.

The shaft 124 is, thus, driven in a single direction (the counterclockwise direction in the illustrated embodiment) by the left and right handlebars 22. In fact, the torque is transmitted to the shaft 124, regardless of the action exerted on the right and left handlebars 22. For instance, the pushing action on the right handlebar 22, even though the right clutch bearing 30 rotates freely about the shaft 124, leads the cables 134 to drive the left pulley 122*a* in the opposite direction, thereby causing the left clutch bearing 130 to transmit the torque to the shaft 124. This permits the application of an adjustable opposition to the movement of the shaft 124 in order to vary the effort required to pivot the handlebars 22. For instance, a primary sheave 146 could be keyed to the shaft 124 and engaged with an endless belt (not shown) to transmit a torque from the shaft 124 to a resisting or damping system (not shown) acting on one of the resistance wheel 70 (FIG. 8).

Figure 11:
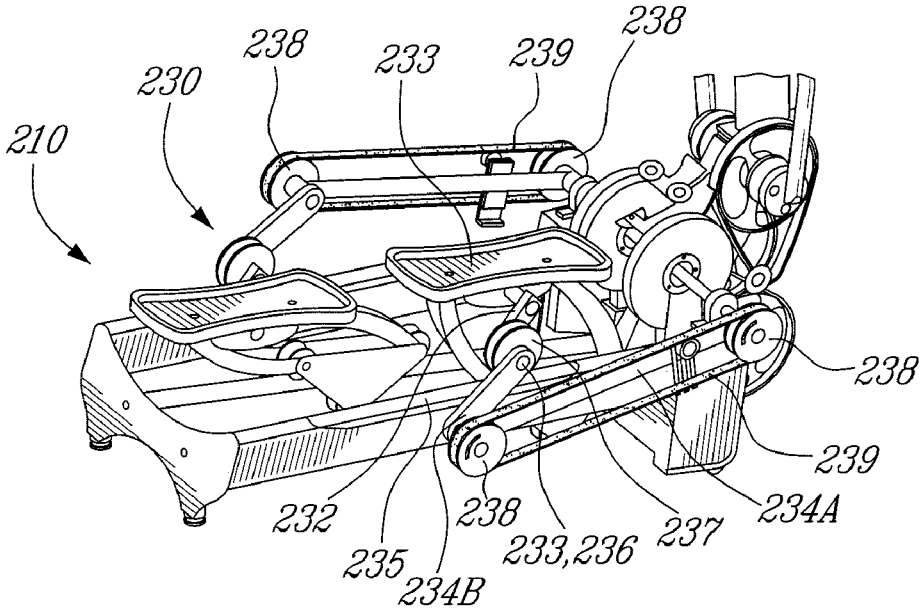
FIG. 11 is a perspective view of an elliptical exerciser in accordance with another aspect of the present invention.

Referring to FIG. 11, an elliptical exerciser operating with the foot pedal mechanism 1' of FIG. 10B is generally illustrated at 210. A foot pedal mechanism is generally shown at 230, and has left and right synchronized mechanism portions. However, for clarity purposes, only the right mechanism portion will be described herein below.

The foot pedal mechanism 230 has a similar construction as the foot pedal mechanism 1' of FIG. 10B, and thus has a crank 232, a foot pedal 233, a link 234A and a link extension 234B. The crank 232 is displaceable in a translating motion onto a straight frame portion 235. More specifically, the crank 232 has a shaft portion 236 mounted to a wheel 237 and rotating freely therein.

Accordingly, the crank 232 can roll on the frame portion 235 (i.e., by the wheel 237) independently of the rotation of the shaft portion 236 therein. The shaft portion 236 is connected to the extension 234B. The foot pedal 233 is connected to the free end of the crank 232. Therefore, a rotation of the crank 232 will have the foot pedal 233 execute a rotational path about an axis of rotation 233' thereof. On the other hand, the connection between the link 234A and the extension 234B will add a translation to the axis of rotation 233' of the crank 232. The combination of the translation motion of the axis of rotation 233' of the crank 232 and the rotation of the foot pedal 233 about the axis of rotation 233' of the crank 232 will result in the foot pedal 233 being displaceable along an elliptical path.

The pulleys 238 and belts 239 (or alternatively, equivalent sprockets and chains or the like) are used to synchronize the motion between the left and right foot pedals. The synchronization will ensure that the foot pedals 233 follow continuous elliptical paths, with the foot pedals 233 being diametrically opposed in the elliptical paths. Links 240 act as a parallel mechanism to keep the foot pedals 233 generally horizontal.

Figure 12:
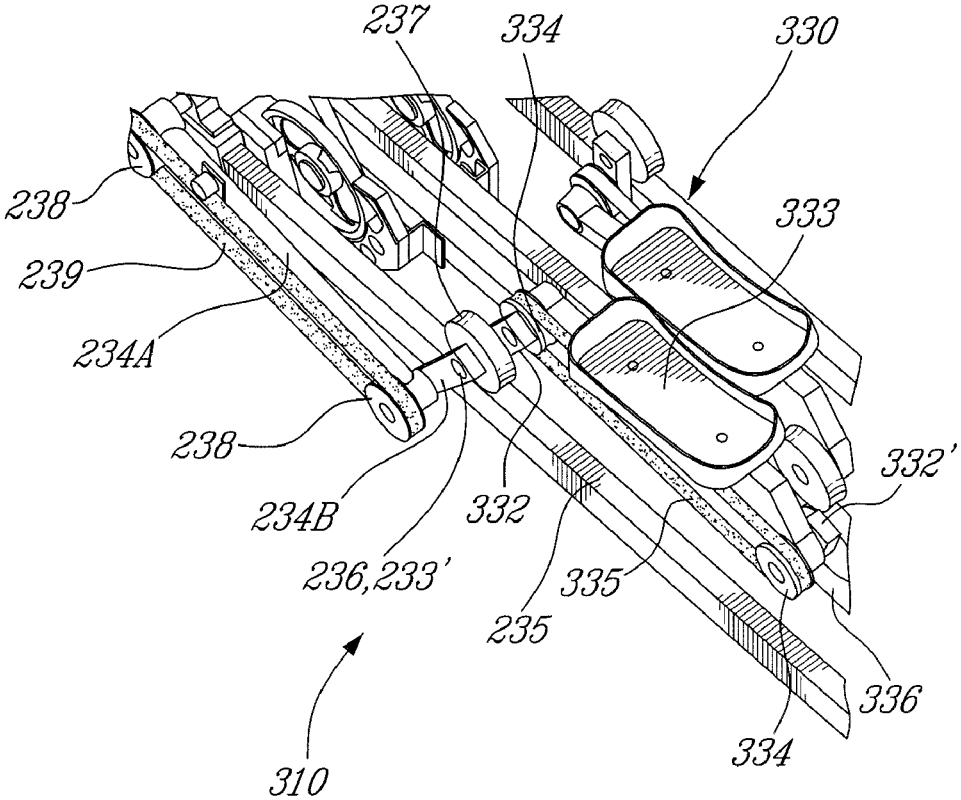
FIG. 12 is a perspective view of an elliptical exerciser in accordance with yet another aspect of the present invention.

Referring to FIG. 12, an elliptical exerciser operating with the foot pedal mechanism 1" of FIG. 10C is generally illustrated at 310. A foot pedal mechanism is generally illustrated at 330, and has left and right synchronized mechanism portions. For clarity purposes, only the left mechanism portion will be described herein below.

The foot pedal mechanism 330 has a similar construction as the foot pedal mechanism 1" of FIG. 10C, and has a crank 332 and a foot pedal 333. The foot pedal mechanism 330 differs from the foot pedal mechanism 230 of FIG. 11 by the fact that the foot pedal 333 is retained at a rear end thereof by a second crank 332'. Therefore, unless otherwise indicated, like elements will bear like reference numerals. The second crank 332' follows the motion of the first crank 332 by way of pulleys 334 and belt 335. The second crank 332' is similar in construction to the first crank 332, in that it has a shaft portion freely rotatable in a wheel which rolls on a frame portion, herein frame portion 336.

We claim:

1. A foot pedal mechanism for an elliptical exerciser comprising:

a frame;

a pair of foot pedals adapted to each support thereon a foot of the user standing on the elliptical exerciser;

a crank for each said foot pedal, each said crank being operatively connected to a respective one of the foot pedals such that a rotation of each said crank about an axis of rotation thereof causes a first motion restriction of the respective one of the foot pedals; and first linkages interconnecting said cranks to the frame such that at least the axis of rotation of each said crank is displaceable with respect to the frame and with the axes of rotation of the cranks being generally displaceable in opposite directions to cause a second motion restriction of the respective one of the foot pedals, a combination of said first and second motion restrictions resulting in the foot pedals being restricted to an elliptical path of motion, the cranks being interconnected to synchronize a displacement of the foot pedals with respect to one another along the elliptical path of motion.

2. The foot pedal mechanism according to claim 1, wherein the first linkages each have a pair of pivotally interconnected links, with opposed ends of the links being respectively connected to the axis of rotation of the cranks and to the frame.

3. The foot pedal mechanism according to claim 1, wherein the first motion restriction is a circular motion about the axes of rotation of the cranks, and the second motion restriction is a translation of the cranks on the frame.

4. The foot pedal mechanism according to claim 3, wherein the translation of the cranks on the frame is effected by each said crank being provided with a rolling portion displaceable on the frame.

5. The foot pedal mechanism according to claim 1, wherein the first motion restriction is a circular motion about the axis of rotation of the cranks, and the second motion restriction is an arcuate rocking of the cranks with respect to the frame.

6. The foot pedal mechanism according to claim 1, further comprising a pair of auxiliary cranks each associated with one of said cranks, the auxiliary cranks each being connected to a respective one of the foot pedals, and being driven by said cranks to maintain the foot pedals parallel in the elliptical path of motion.

7. The foot pedal mechanism according to claim 1, wherein the first linkages each have a first link pivotally connected at opposed ends to the axes of rotation of the cranks and to the frame.

8. The foot pedal mechanism according to claim 7, further comprising second linkages between each said crank and a respective one of the foot pedals, the second linkages having:

a second link for each crank, each said second link being pivotally radially connected to the crank and to the frame such that a free end of each said second link is displaceable in the first motion restriction;

a third link for each crank, each said third link being pivotally connected to the axis of rotation of the crank such that a free end of the third link is displaceable in the second motion restriction; and a fourth link for each crank, each said fourth link being pivotally connected to the free ends of respective ones of the second link and the third link, and to the foot pedal, to transmit the first and second motion restrictions to the foot pedal.

* * * * *